United States Patent [19]

Möbius et al.

[11] 3,972,513

[45] Aug. 3, 1976

[54] METHOD AND APPARATUS FOR TREATING AND ANNEALING FERROUS AND NON-FERROUS ARTICLES

[76] Inventors: Hans Eberhard Möbius, Michael-Tritz-Str. 4, D-6622 Wadgassen; Sorayapour Soraya, Kurt-Schumacher-Allee 84, D-663 Saarlouis, both of Germany

[22] Filed: Aug. 7, 1974

[21] Appl. No.: 495,423

[30] Foreign Application Priority Data

Mar. 1, 1974 Germany.....2409818

[52] U.S. Cl...... 266/130; 148/16

[51] Int. Cl.[2]..... C21D 1/26; C21D 9/00

[58] Field of Search..... 266/4 R, 5 R, 5 A, 5 B, 266/5 C; 148/13, 13.1, 16, 20.3

[56] References Cited

UNITED STATES PATENTS

| | | | |
|---|---|---|---|
| 2,899,192 | 8/1959 | Fritz | 266/5 A |
| 3,169,158 | 2/1965 | Wigg | 266/5 R |
| 3,782,705 | 1/1974 | Westeren et al. | 266/5 R |

*Primary Examiner*—Gerald A. Dost
*Attorney, Agent, or Firm*—Otto John Munz

[57] ABSTRACT

An apparatus for rapid batchwise heating and/or annealing ferrous and non-ferrous materials in piece form has an inlet chamber for the introduction of the material, including an inlet lock and a roller table, with means to close the lock and to evacuate the chamber to a vacuum up to $1 \times 10^{-2}$ mm Hg; a furnace chamber with a metal bath compartment located underneath, with means to heat it to a metal vapor rising temperature; a lock valve between the inlet lock and the second chamber and means to transfer the material from the inlet chamber to the furnace chamber under evacuation; a second valve located between the furnace chamber and its means to heat it; means to controllably open the second valve on closing of the lock valve; means to evacuate the metal vapors and to disconnect the furnace chamber from the heating means to cool the furnace chamber after annealing to a condensing temperature of the metal; a cooling chamber with an outlet lock and means to evacuate and cool the material below oxidation levels and means to discharge the liquified metal from the furnace chamber to the cooling chamber.

In the process, the furnace is evacuated, the material is introduced into it in batches and exposed to heat treatment by vapors of the boiling metal bath to obtain the desired annealing temperature. After cooling the condensate formed on the heated material is returned to the metal bath and the furnace chamber is free of metal vapors. The discharge of the metal from the metal bath and the escape of metal vapor from the furnace chamber are prevented and washing, rinsing and drying after annealing become unnecessary.

29 Claims, 12 Drawing Figures

METHOD AND APPARATUS FOR TREATING AND ANNEALING FERROUS AND NON-FERROUS ARTICLES

BACKGROUND OF THE INVENTION

1. Field of the Invention

This invention relates to a method for the rapid heating and annealing of material comprising a ferrous or non-ferrous metal and is particularly useful where the material is of small cross-section or a shallow surface layer is to be treated.

2. Description of the Prior Art

Previous attempts to increase the heat transfer coefficient, when heating materials, have disadvantages. Salt baths have the disadvantage that salt is discharged together with the material treated, while in addition the heat transfer coefficients are limited to about 2000 kcal./m$^2$.h.°C.. The customary metal baths also have the disadvantage that the metal is discharged together with the material heated. Furthermore, metal baths can usually be used only in a continuous process. If, for example, entire wire coils were to be dipped into a metal bath, the bath would solidify in the interior of the wire coil and the high heat transfer coefficient would be lost. The consequence is a very irregular rise in temperature and thus an irregular heat treatment.

The prior art discloses a method for the continuous heat treatment of strips, wherein not only is a metal bath used, but, in addition, sodium metal vapor is used in a middle region of a furnace for the purpose of heating to 882°C. This method constitutes an improvement and is to be preferred for strip. It is true that the specification also recommends the continuous treatment of wire in the same way. This procedure entails disadvantages in the case of wire, as only thin wires can be passed effortlessly through the plant. Thicker wires require a bending device before each change of direction and this solution must be immediately rejected. Furthermore, in the case of wire the discharge of metal and consequently the expense in respect of the water baths which have to be connected for the purpose of removing the discharged metal and in respect of the drying device is extremely high. In addition, run-off crowns and welding devices are required upstream of the plant and shears and reels on the downstream side.

SUMMARY

The Objects of the Invention

According to the present invention there is provided a method for the rapid heating and/or annealing of material comprising a ferrous or non-ferrous metal, wherein the material in piece form is introduced into a chamber and the chamber is evacuated, whereupon a heat carrier in the form of the vapor of a boiling metal bath is introduced into the chamber, the condensate formed on the material being heated being returned to the metal bath, and wherein, on termination of the heat treatment, the chamber is freed of metal vapor by disconnecting the metal bath from the chamber and by cooling the chamber. The chamber may be cooled by introducing a cooling element into the chamber or by the passage of coolant through cooling means associated with the chamber. The metal vapor used as heat carrier should be so selected that a pressure of from 0.1 to 5 atmospheres, preferably 0.5 to 1 atmosphere, has to be adjusted in order to obtain the desired annealing temperature, the latter corresponding to the condensation temperature of this vapor at a predetermined pressure.

The present method may be carried out in a self-contained furnace which is equipped with vacuum inlet and outlet locks. The material to be treated should therefore also usually be used in the bright state; it is bright-annealed in the furnace.

In the present method, the protective gas which is otherwise customary in bright-annealing is replaced by the metal vapor. No additional protective gas is required during the heating and annealing.

BRIEF DESCRIPTION OF THE DRAWINGS

In order to enable the invention to be more readily understood, reference will now be made to the accompanying drawings, which illustrate diagrammatically and by way of example some embodiments thereof, and in which.

DESCRIPTION OF THE PREFERRED EMBODIMENTS

Throughout the drawings same or equivalent parts bear the same numeral or numerals followed by letters, respectively, and repetitions of the necessary or desirable parts in the several embodiments are omitted for brevity purposes.

Figure 1:
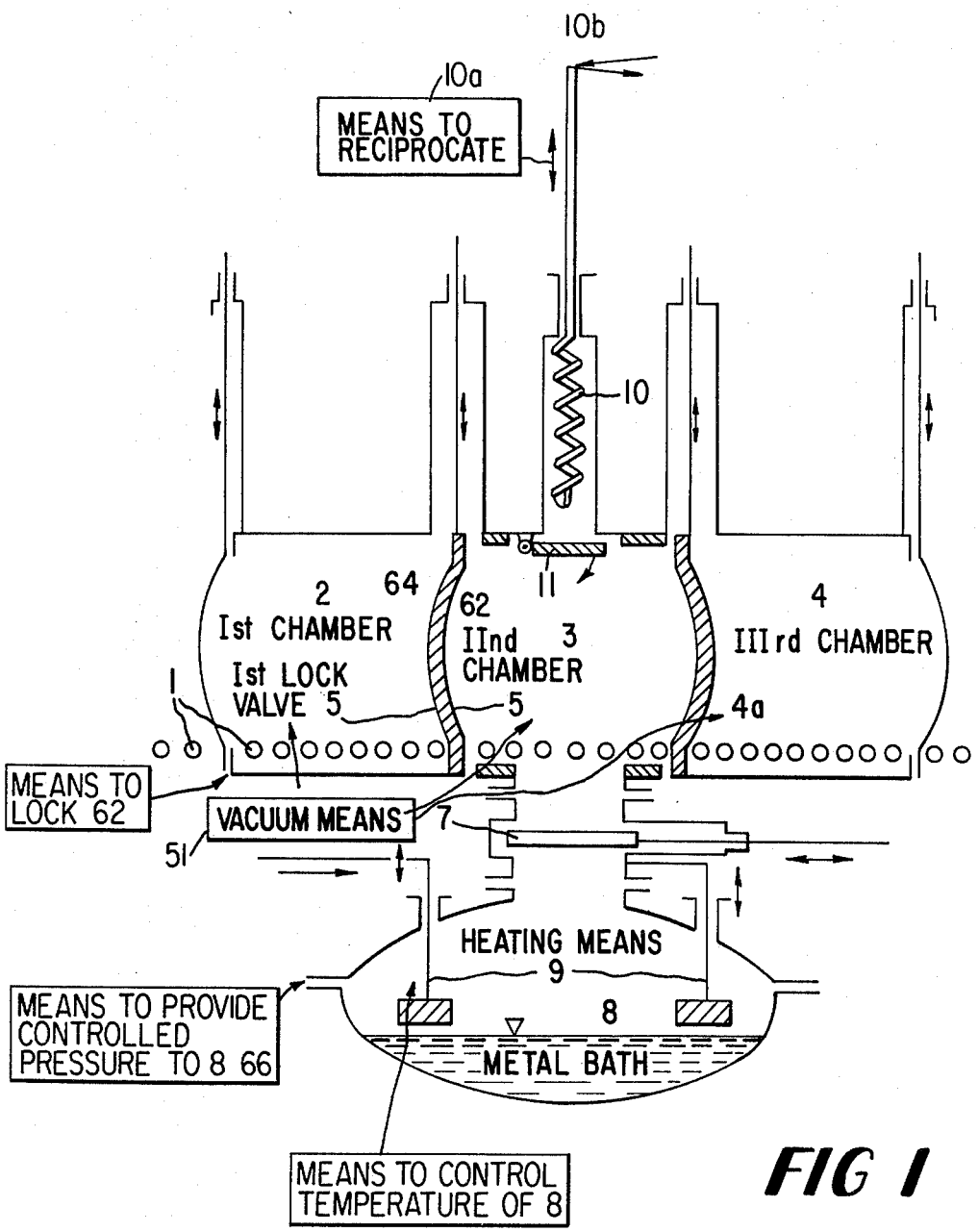
FIG. 1 is a section through a basic embodiment of the furnace of the invention for the batchwise heating of material.

Referring not to FIG. 1 of the drawings, there is shown a basic furnace of the invention, having at least three chambers for the batchwise heating of material in piece form. The material to be treated is brought into the first chamber of the furnace which is in the form of an inlet lock 2 on a roller table 1. The lock is closed and evacuated by a vacuum means 51. At this time a metal bath 8 located under the second chamber 3 of the furnace has already been heated, for example with the aid of electrodes 9. After a final vacuum of e.g. $1 \times 10^{-2}$ mm Hg has been reached, a first valve 5, which is a lock valve between the inlet lock 2 and the furnace chamber 3, is opened and the material is pushed into the evacuated furnace chamber 3. After the lock valve has been closed, controlled opening of a second valve 7 separating the furnace chamber 3 from the metal bath 8 follows. Hot metal vapor flows into the furnace chamber 3, and depending upon the material to be heated, means may be provided for preferentially directing this flow of vapor within the chamber and in relation to the material. The vapor condenses on the material being annealed, and the condensate drips off the latter into the metal bath 8, where it is again vaporized. The annealing temperature of steels is usually reached in less than 5 minutes, and preferably in less than 1 minute. This is dependent only upon the installed heating power for the metal bath 8. The holding time now required is determined in conventional manner by the thermal conductivity of the material being heated and requirements in respect of structure. On termination of the annealing time, the valve 7 between the furnace chamber 3 and the metal bath is closed, and cooling is effected.

The cooling may be effected by condensing the metal vapor remaining in the furnace chamber 3 on an oil-cooled or gas-cooled cooling finger 10 which is introduced into the furnace chamber 3 after the opening of a valve 11.

Alternatively, the annealed material may be sprayed with liquid metal or the furnace chamber 3 maybe floodedwith liquid metal or gas, or the annealed material may be dipped into a metal bath.

The temperature of the gaseous or liquid cooling medium is selected in accordance with the material and the cooling requirements. A cooling finger 10 is also used after the alternative cooling treatment in order to condense residues of the metal vapor remaining in the furnace chamber 3 from which the liquid metal has been discharged. The furnace chamber 3 which is free from vapor, that is to say under vacuum, can then be flooded with an inert gas. This inert gas can moreover be used before or during the utilization of the cooling finger 10 if rapid and excessively low cooling through the vaporization of liquid metal adhering to the annealed material is to be prevented. The cooling of the heated material below the oxidation limit is effected in the third chamber of the furnace which is in the form of an outlet lock 4. This cooling can be intensified by water-cooled cooling elements in the walls of the lock 4, by means of a cooling gas, or by means of a metal bath preceding the lock.

With the use of the present furnace, it is possible to prevent the discharge of the metal of the metal bath 8 with the annealed material and the escape of metal vapor from the furnace. A protective gas is not indispensable for the performance of the process. After annealing, no washing, with the consequent rinsing and drying of the material, is required. The furnace therefore does not necessitate the use of liquid metal pumps. The entire furnace plant is simple and operationally reliable. Finally, the present method and furnace are adaptable in respect of the material to be heated and of the capacity to be adjusted. Any desired material, for example die forgings, connecting elements, entire wire coils or bundles or rods, can be annealed in the furnace. Furthermore, in contrast to the previously proposed methods, the present method is variable in respect of the choice of annealing temperature, because with one and the same heat carrier, for example sodium, a pressure equal to or lower than 1 atmosphere or else equal to or higher than 1 atmosphere and consequently an annealing temperature equal to or lower than 833°C or equal to or higher than 883°C can be selected.

Preferred low-melting metals which are suitable for use in the present method include sodium, potassium, bismuth, and lithium, the relevant properties of these metals being:

| | Sodium | Potassium | Bismuth | Lithium |
|---|---|---|---|---|
| Melting point °C | 97.7 | 63 | 271 | 180 |
| Boiling point °C | 883 | 760 | 1477 | 1317 |
| Heat of condensation kcal./kg. | 1005 | 496 | 204 | 4680 |
| Specific heat of condensation kcal./dm.$^3$ (approximate) | 750 | 300 | 1800 | 1900 |

In the present method, these metals or other low-melting metals which are suitable for desired annealing temperatures can be used.

Furthermore, the present method provides a new kind of temperature control, namely the control of the heating of the metal bath through the pressure above the latter, the condensation temperature being determined by this vapor pressure. Because of this interdependence of the vapor pressure and temperature, after thermal equilibrium all elements of the material heated have practically the same surface temperature. Colder parts of the material heated bring about more intensive condensation of the metal vapor, so that there is a continuous corrective equilization of the transfer of heat at all points on the material being heated.

The metal bath 8 can be heated by conventional means, that is to say by means of radiant tubes or plasma burners, electric heating elements disposed above or in the bath, or by heating the vessel containing the metal bath 8. Because of the high power of the furnace 3, however, very powerful heating is necessary if all the advantages of the method are to be exploited. Heating is therefore preferably effected with the aid of plasma arcs, the plasma of which consists of the particular metal to be employed, for example sodium, and which are struck between highly heat-resistant electrodes, for example tungsten electrodes, and the metal bath 8. Preferably three-phase current is used so that three or multiple of three electrodes may be used. Power is controlled by the voltage applied and by adjusting the distances between the electrodes and the surface of the bath.

The present method is also suitable for rapidly heating the surface of large bodies, for example cold rolls, where a shallow surface layer may be heated. For example, in the case of cold rolls, a layer of a thickness of about 30 mm is austenitized in about 5 minutes and thereupon quenched from outside by a coolant and from inside by the core of the roll, which has remained cold.

The present method can for example also be used for preheating and heating fine scrap to a temperature near the melting point, the procedure being the same as that illustrated in FIG. 1, with the exception that the cooling steps are omitted.

It is also possible to carry out discontinuously complex heat treatments, which consist of individual process steps, in individually closable chambers of furnace plants which can be kept under different vapor pressures and consequently at different temperatures or can be brought to the different temperatures.

The individual steps of such a heat treatment generally consist of preheating in one or more stages, annealing, quenching, and cooling, optionally followed by further heating and annealing at a second temperature, and finally cooling to room temperature in one or more stages.

Examples of such treatments comprising a plurality of steps are the following:

Hardening and tempering can be carried out by austenitizing in a sodium vapor furnace, hardening in a sodium-potassium melt, and tempering in a second sodium vapor furnace. The grades suitable for hardening and tempering are unalloyed, low-alloy, and also high-alloy heat-treatable steels. The sodium vapor furnace provides fast-acting austenitization, which results in a finger grain. It also permits economical multiple hardening which leads to a still smaller grain. Fast-acting tempering which leads to markedly greater toughness is also possible. (Techn. Zeitschrift fur praktische Metallbearbeitung Vol. 67 — Aug. 1973 — No. 8 — pages 293 to 298).

Austempering can be applied in the case of unalloyed and low-alloy heat-treatable steels. It is to be preferred when the semi-finished product has to undergo a large or extremely large amount of cold working. The process steps comprise preheating, fast-acting austenitization, isothermal holding at the temperature with earliest termination of the intermediate stage transformation and cooling. In comparison with customary austempering in salt baths, austempering can be carried out more accurately and rapidly by the present method.

Isothermal annealing is preferred in the case of steels to be subjected to stock-removing machining, unalloyed and low-alloy steels being mainly concerned. The steps are: preheating, austenitizing, isothermal holding the perlitizing, cooling.

Figure 2:
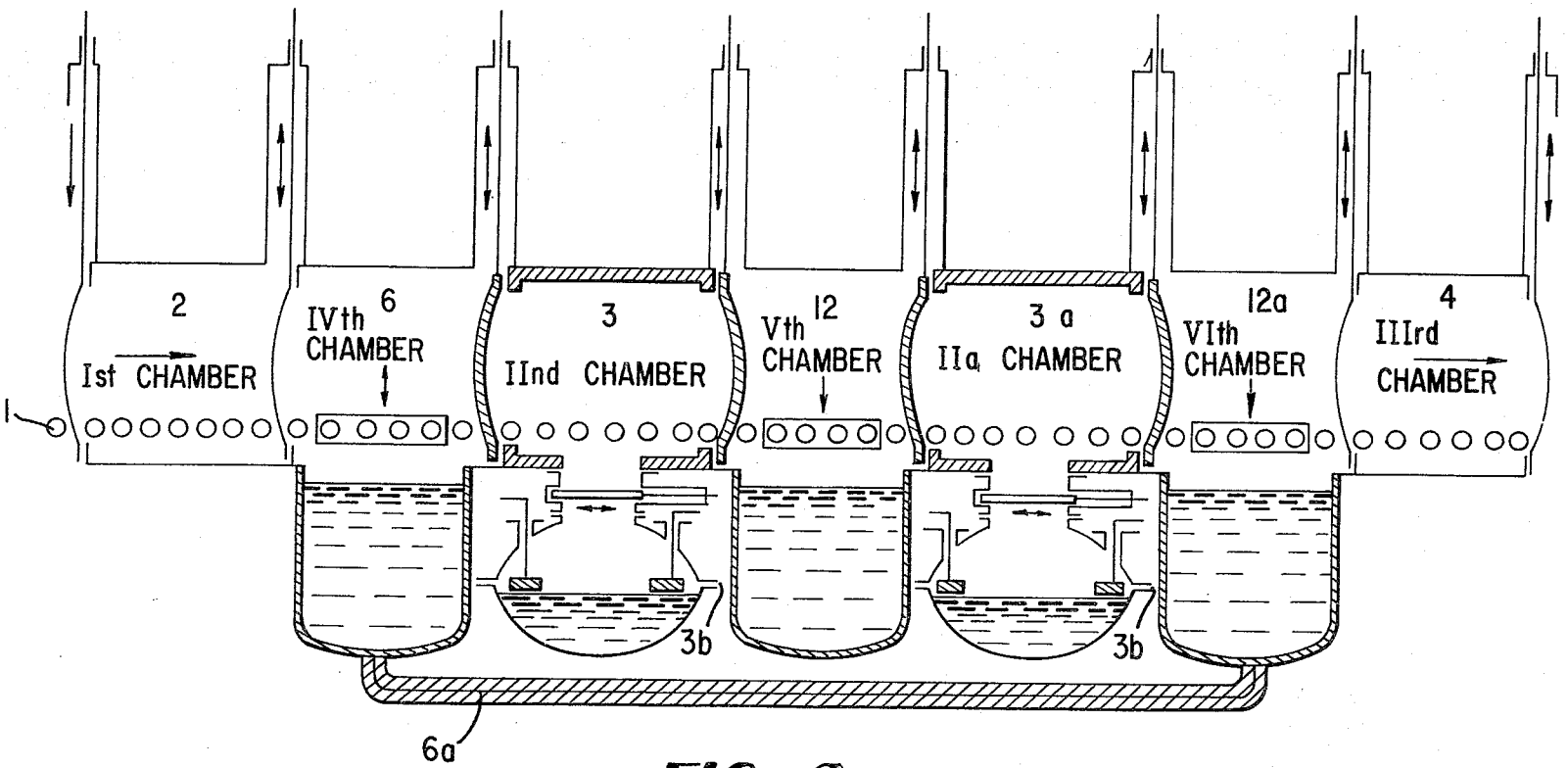
FIG. 2 is a section through a furnace shown on FIG. 1 with additional improvement for the heat treatment of a material in a plurality of stages.

FIG. 2 shows furnaces suitable for these kinds of heat treatment in a plurality of stages additional to those described on FIG. 1, in which treatment chambers succeed one another in a line. The material to be treated is brought into the first chamber 2 by means of the roller table 1. In a preheating fourth chamber 6*a*, sequentially interposed between the first and the second chambers, the material is immersed in a preheating bath which is in communication with a cooling bath. The material is heated to the annealing temperature in the second furnace chamber 3, quenched or cooled in a fifth furnace chamber 12*a* by immersion in a cooling bath, reheated in a VIth furnace chamber 3*a*, cooled again in the sixth furnace chamber 12*b*, and discharged through the third furnace chamber 4.

Figure 3A:
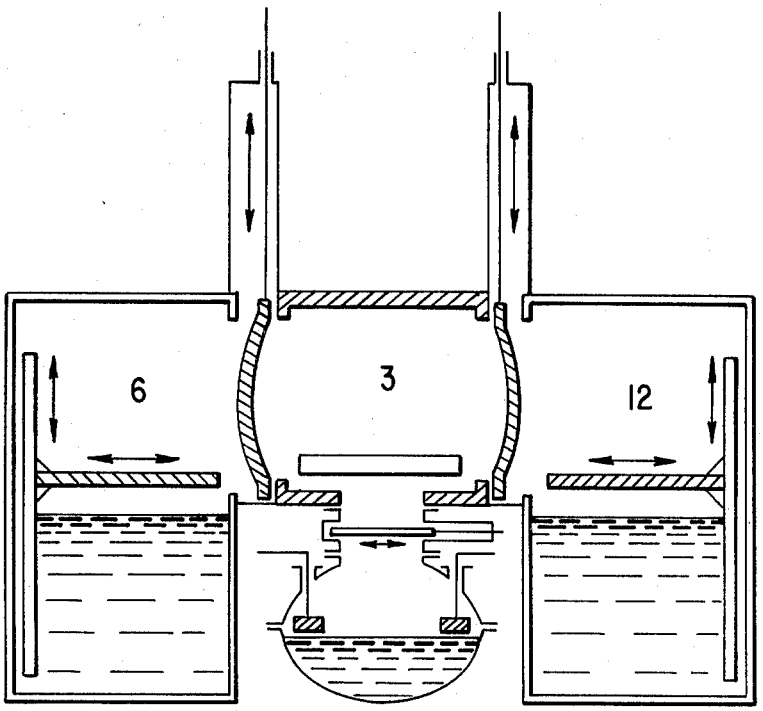
FIGS. 3*a* and 3*b* are a cross-section through and a sectional plan view, respectively, of the furnace, shown in FIG. 1 with additional cost reducing improvements.
Figure 3B:
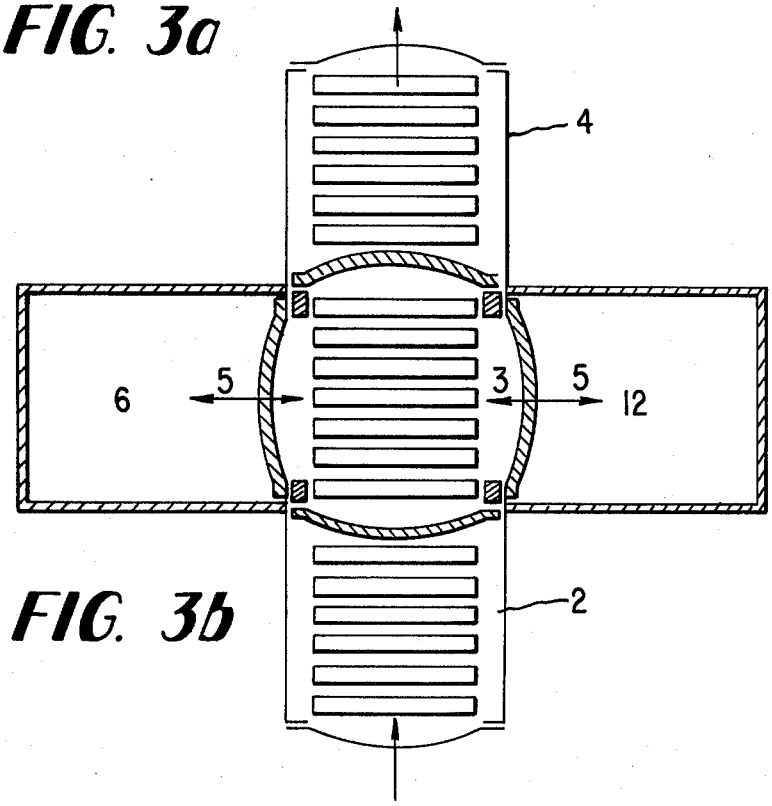

FIGS. 3*a* and 3*b* show a furnace by means of which it is possible to reduce the cost at the expense of furnace capacity. To the linear assembly of the first, second and third chambers are added crosswise chambers 6 and 12, each adjacent to the second chamber in opposite directions. Thus a chamber 6 containing a bath for preheating material and a chamber 12 for quenching or cooling material are connected in a cruciform arrangement to the central furnace chamber 3 which is similar to the chambers 3 shown in FIGS. 1 and 2.

Figure 4:
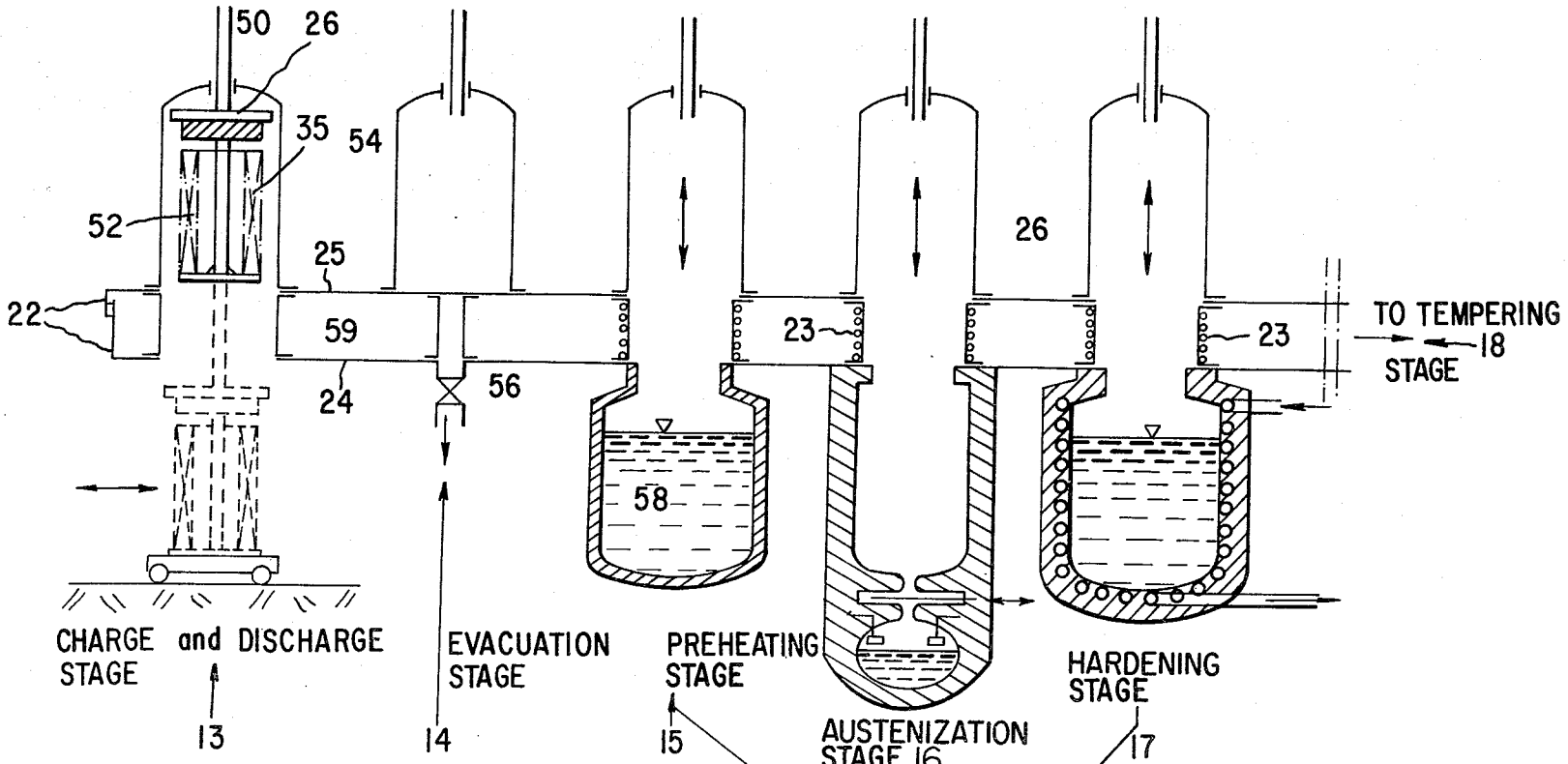
FIGS. 4 and 5 are sections through an arrangement for the heat treatment of a material in a plurality of stages, which are arranged in a circle.
Figure 5:
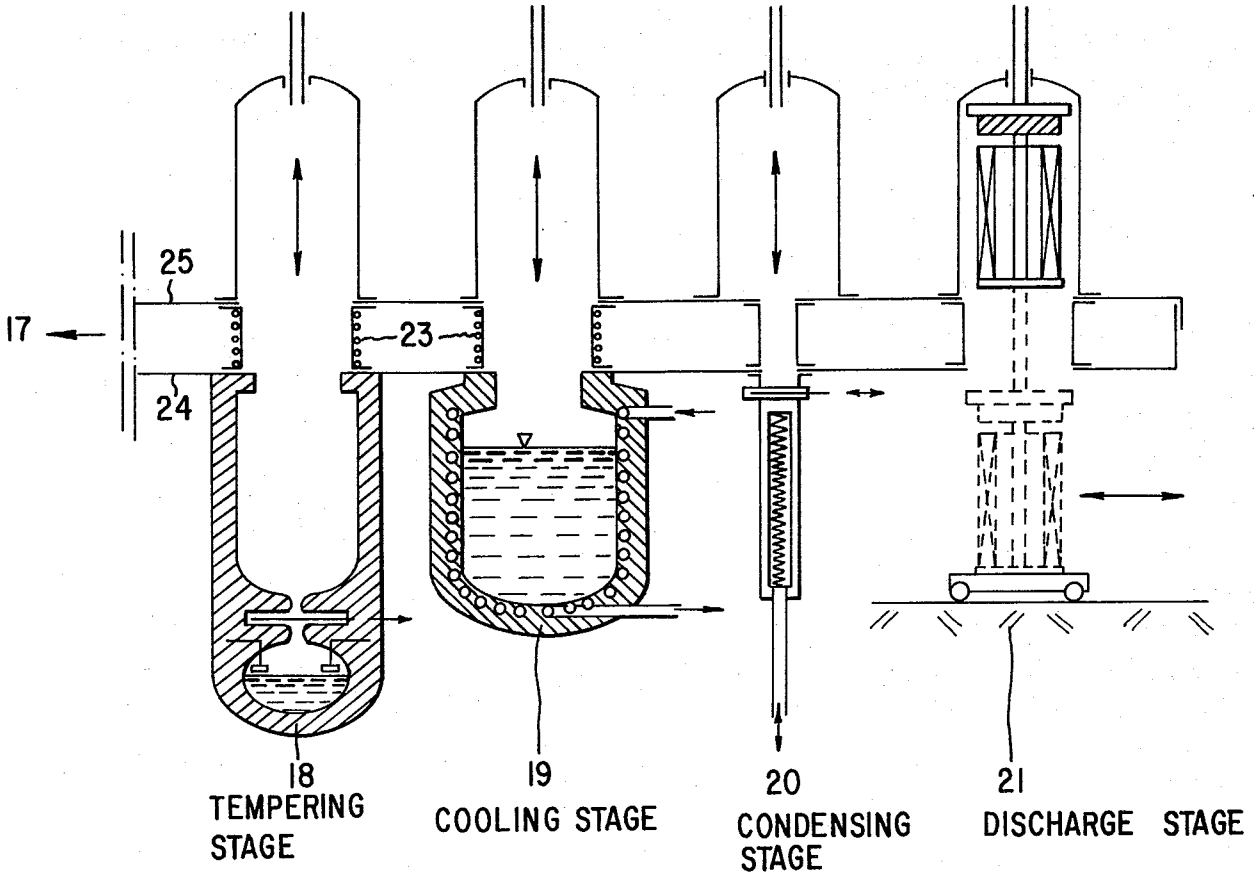

The treatment can also be effected by means of an arrangement of hoods 54 and pots 58 as illustrated in FIGS. 4 and 5. In this arrangement treatment baths and a sodium vapor furnace are connected to a bottom plate 24. A movable top plate 25 which is provided with hoods 54 is disposed above the bottom plate. The hoods receive the material being heated during transport from one treatment chamber to the other. From these hoods the material being heated is lowered hydraulically or mechanically into the individual treatment chambers.

The top and bottom plates 25 and 24 respectively, enclose in conjunction with an outer wall 22 a chamber 59 which is under vacuum (FIG. 4).

The connections between the lower treatment chambers and the hoods disposed at the top are made by tubular elements 23, which lie with their flanges at both ends against the upper and lower plates. These tubular elements are made resilient in the axial direction, for example by constructing them of two parts, and pressing the upper part resiliently against the upper plate by means of hydraulic cylinders or oleohydraulically with the aid of an annular chamber. On the turning of the upper plate the pressure applied by the upper part of the tubular element can thus be controlled. The tubular elements can be provided with a cooling system. The vapors entering the tubular elements then condense on the walls of the latter.

The operation of the plant is shown in FIGS. 4 and 5 in a sequence and will now be described with reference to the hardening and tempering of steel.

In position 13 a central carrier rod 50 is driven out in the downward direction and receives the charge 52. Discharging is also effected in the same position. After the charge has been pulled into the hood 54, the upper plate is turned through a fixed angle to the position 14. The hood is evacuated. After the desired vacuum has been reached, the valve 56 is closed. The top plate is turned through the same fixed angle to position 15. The charge is preheated in a preheating bath 57 which is in heat exchange with the hardening bath. In the following position 16, the austenitization of the charge is effected in the metal vapor furnace, a cover 26 carried by the carrier rod above the charge resting firmly on a flange of the furnace during this operation. (The type of seal between the cover and the flange can be seen in FIGS. 9 and 10). Hardening is effected in position 17. The following treatment stages comprise tempering in position 18, cooling in position 19, condensing of residual vapors inside the hood in position 20, and discharge in position 21.

In all cases the upper plate carries a plurality of hoods, so that on every new change of position, hoods containing charges are disposed above all the treatment chambers.

Figure 6:
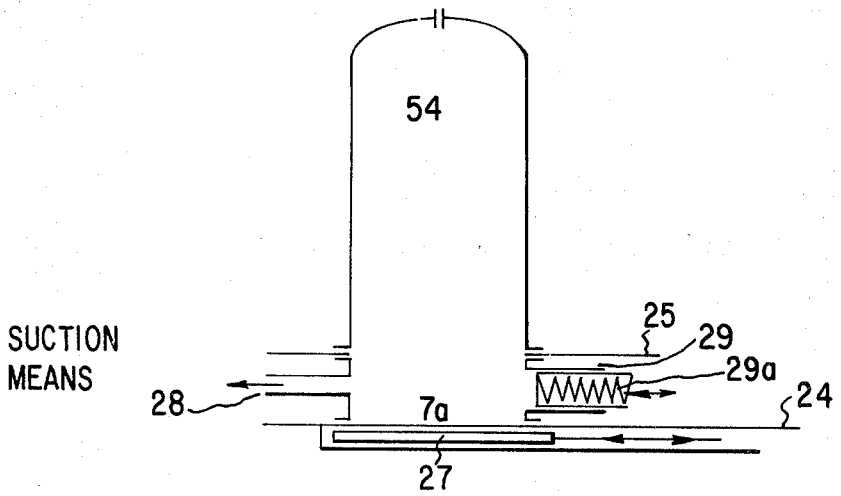
FIGS. 6 and 6*a* are a section and plan view respectively of a modification of the arrangement shown in FIGS. 4 and 5, showing a circular sequence of operations.
Figure 6A:
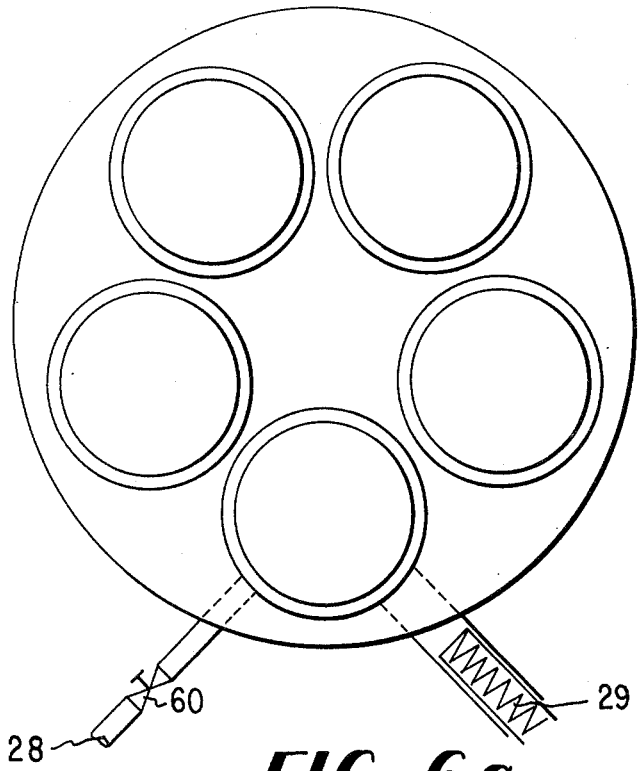

FIGS. 6 and 6*a* show, in contrast to FIGS. 4 and 5*a* very compact construction with the positions 13, 14, 20, 21 combined into one. A lock valve 27 is connected to the lower plate 24 under the orifice for charging and discharging, thus making it impossible for the neighboring treatment chamber to be flooded through this orifice when the hood is in an intermediate position. The tubular element between the upper and lower plates, directly above the valve 60 shown in FIG. 6*a*, carries a suction connection 28 for the evacuation of the hood after charging and a cooling trap 29 for condensing residual gases before discharging.

Figure 7:
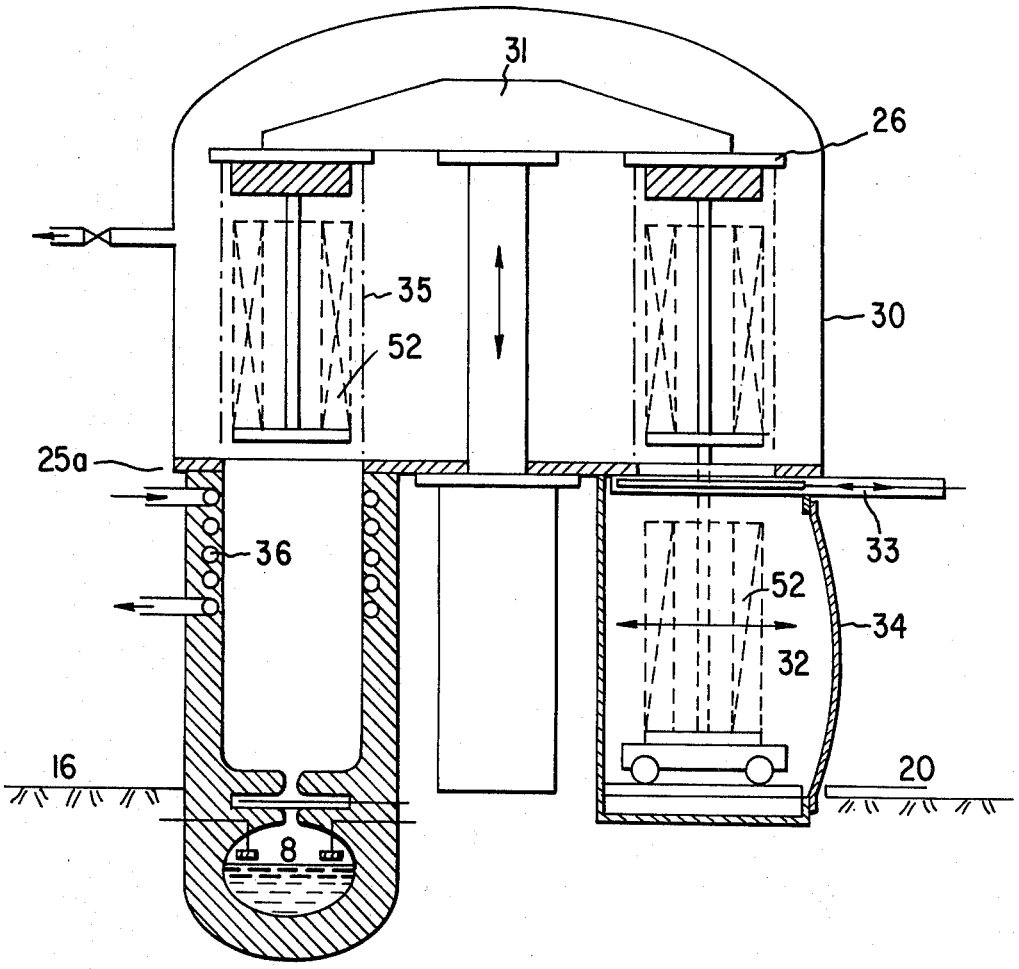
FIG. 7 is a section through yet another furnace.

The arrangement can however also be modified by using only one plate 25*a*, to which the metal vapor furnaces and treatment baths are connected from below, charging and movement being effected above this plate. In order to prevent the admission of the atmosphere into the individual baths during charging, various solutions are possible. FIG. 7 shows a furnace with a hood 30 which covers the entire arrangement. In this furnace, the material being annealed is carried and turned by a turntable 31, with means to raise it and to lower it. This construction makes it necessary for a lock 32 or two such locks to be connected to the plate for the purpose of charging and discharging. The lock is closed in relation to the hood by a horizontal lock valve 33 and in relation the outside by a vertical lock door 34.

Cooling between two treatment stages can be avoided in the present case by disposing a radiation guard 35 around the charge, the guard being suspended on the cover and penetrating into the treatment chamber together with the charge. In this case the hood mounted on the plate must be insulated where radiation occurs. It is however also possible to provide above the plate a radiation guard which does not penetrate into the treatment chambers, that is to say which either participates in the movement in the region of a cross-member of the turntable or else frees the path for the charge after the style of a door.

In order to prevent metal vapor from penetrating into the upper hood after annealing inside the vapor furnace, the wall of the vapor furnace is preferably provided in the upper region with a cooling coil 36, for example fed with nitrogen, oil, or a sodium-potassium melt. In this region of the furnace wall, the condensation and possibly the solidification of the residual vapors take place.

Figure 8:
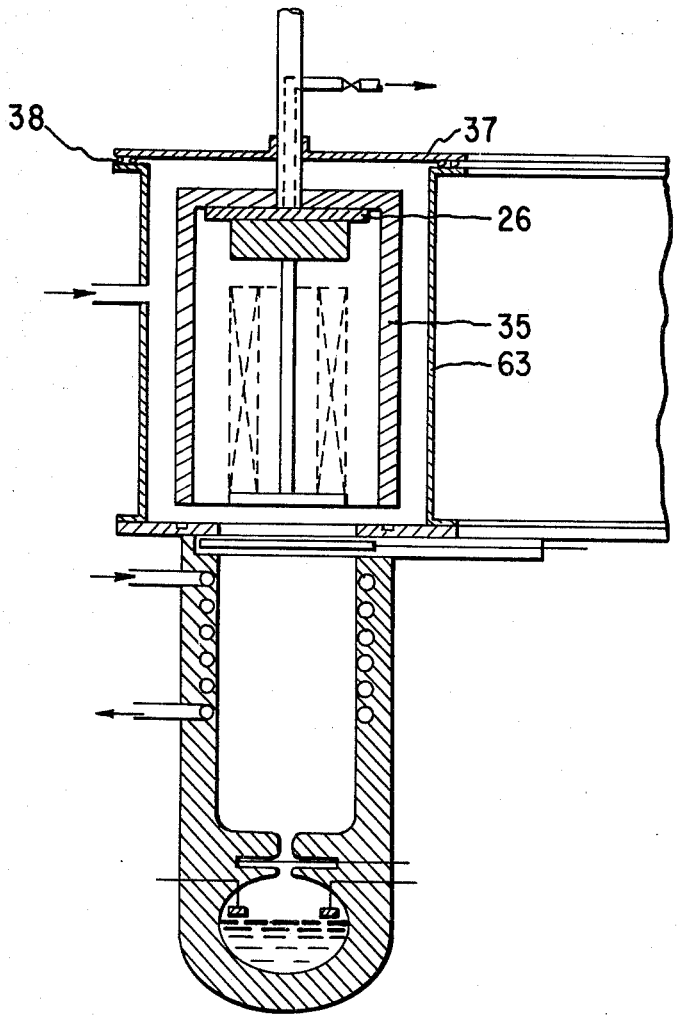
FIG. 8 is a section through yet a further furnace.

Another construction of the furnace system is shown in FIG. 8. This furnace shown in FIG. 8 differs from that shown in FIG. 7 in that the hood above the plate is replaced by an annular tunnel 63, the annular cover 37 of which participates in orbiting movement of the material to be annealed. Sliding seals 38 are therefore provided between the wall of the tunnel and the cover.

In the present metal vapor furnaces, use is made of the double vacuum furnace system, which is known per se. The internal metal lining 62 of the furnace is relieved of pressure and can therefore be of slight thickness (see FIG. 1). Its sole purpose is to secure the vacuum or to prevent the metal vapor from penetrating into the outer layers of the furnace. Directly behind the metal lining lies thermal insulation 64. This space, filled with insulating medium, is always kept at the same pressure as or at a lower pressure than the interior of the furnace, for example, by differential pressure gauges. Particularly at lower temperatures, an adapted pressure in the insulating space is therefore not necessary; the space containing the insulating medium can in these circumstances be kept under vacuum. The non-supporting inner lining then bears against the insulating material and the latter against the outer wall of the furnace.

Figure 9:
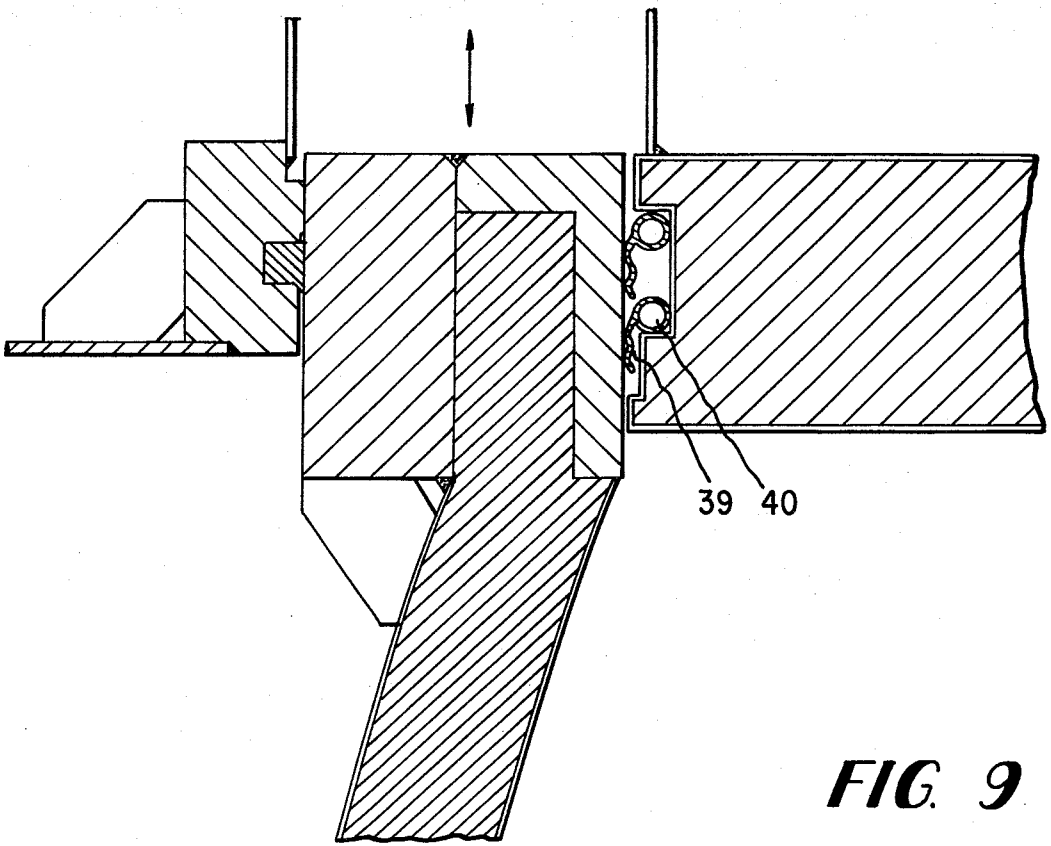
FIG. 9 is a section through a sealing arrangement.

The valves and lock doors can be sealed by utilizing as a sealing medium the metal which is used as a heat carrier. For this purpose, as shown in FIG. 9, an elastic sheet metal lug 39 is vacuum-tightly welded to a tube 40. As soon as the furnace door is closed and the conventional rubber seal has been applied, this tube is cooled, preferably with oil. The actual seal will be formed simply by metal vapors which enter the furnace chamber and condense on the parts where the temperature is lowest, and consequently on the tube and sheet metal lug.

Figure 10:
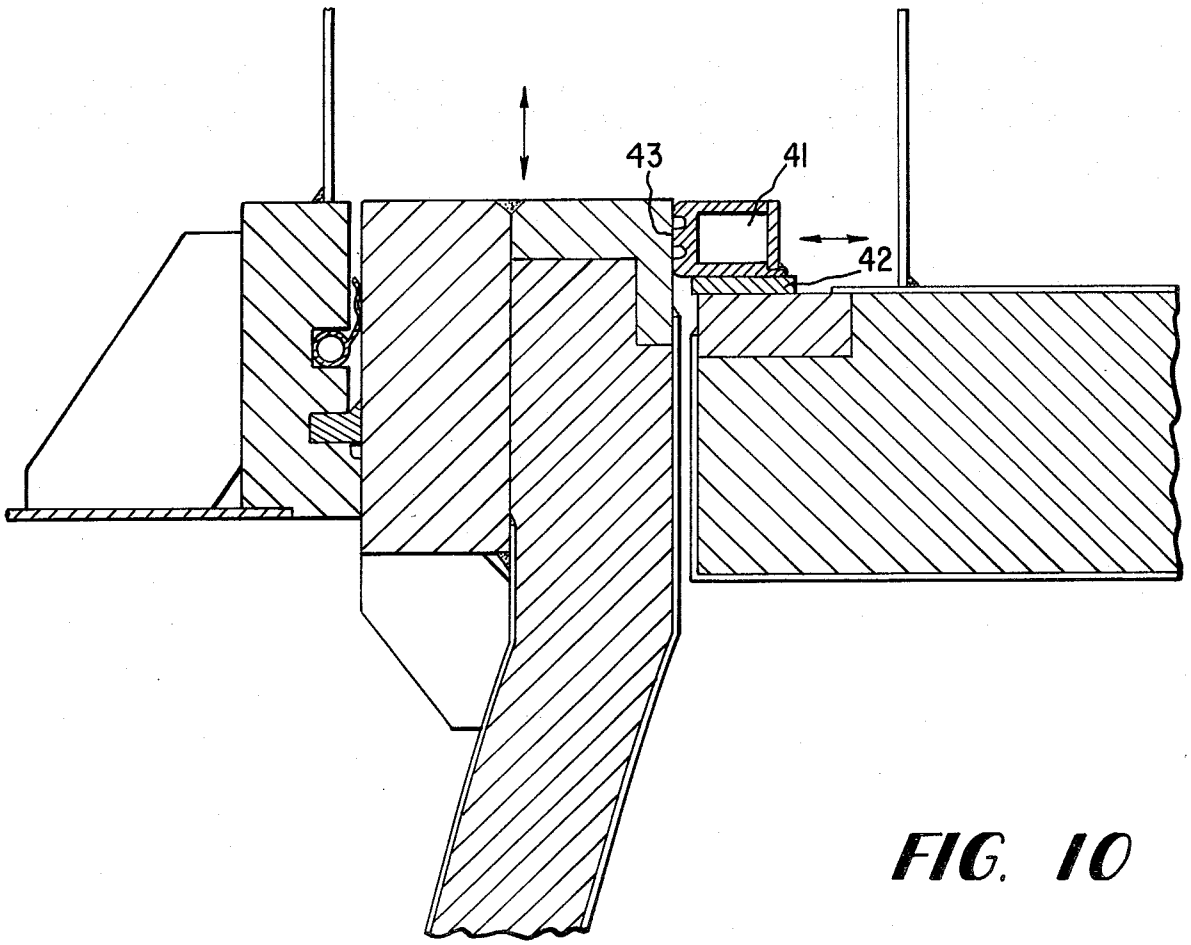
FIG. 10 is a section through another sealing arrangement.

A second example of this kind of seal is shown in FIG. 10. A rectangular tube 41, which is to be cooled, slides on a ring 42 at right angles to a sealing surface 43. After the furnace door has been brought into position, the tube can be pressed mechanically or hydraulically against the sealing surface. The sealing tube or the tube carrying the sealing lug may optionally also be heated if rapid opening is necessary, in order to achieve short idle times.

The valve 7 separating the metal bath from the furnace chamber (see FIG. 1) can be eliminated if the annealing cycles or cycle times are longer and time is thus available to reduce the temperature of the metal bath of the furnace to such an extent that no vapor is formed.

In the furnace plants described, the previously mentioned low-melting metals, sodium, potassium bismuth, and lithium can be used. These metals or mixtures of these metals or metals having a similarly low melting point can also be used for the preheating and cooling bath.

What is claimed is:

1. An apparatus for rapid batchwise heating and/or annealing ferrous and non-ferrous materials in piece form comprising:

at least one air-tight furnace chamber;

means to introduce said material into said airtight furnace chamber;

means to evacuate said airtight furnace chamber while containing said material to a vacuum up to $1 \times 10^{-2}$ mmHg;

means to subject said material in said chamber to boiling metal vapors at a pressure between about 0.1 atmosphere to 5 atmospheres;

a first valve means to withdraw the condensate formed on said material;

and to close off said means to subject said material to vapor, from the said chamber; and means to cool said chamber.

2. An apparatus for rapid batchwise heating and/or annealing as claimed in claim 1, further including:

a first chamber, being an inlet airtight chamber for introduction of said material; said first chamber including:

means to lock said inlet chamber airtight upon introduction of said material, said airtight furnace chamber being a second chamber, including:

a metal bath compartment located underneath said furnace chamber with means to heat it to a metal vapor rising temperature;

a lock valve between said first and said second chambers;

means to transfer said material under vacuum from the said first chamber to the said second chamber;

a second valve means located between said second chamber and said metal bath compartment;

said means to evacuate being means to evacuate selectively said first and said second chambers;

said means to cool including means to cool said second chamber after the annealing time to a condensing temperature, and a third chamber, being a cooling chamber with an outlet lock;

said means to evacuate and said means to cool the material operating below oxidation levels, said means to transfer operating also as means to discharge the liquified metal from the said second chamber to the said third chamber;

whereby after introduction of the material, the said first chamber is evacuated, the material is introduced into the furnace chamber, exposed there to heat treatment by the vapors of the boiling metals and on termination of the heat treatment, the chamber is free of metal vapors and whereby the discharge of the metal from the said metal bath and the escape of metal vapor from the furnace are prevented and washing, rinsing and drying after annealing become unnecessary.

3. An apparatus for the rapid heating and/or annealing of material comprising a ferrous or non-ferrous metal as claimed in claim 1, said means to cool being a cooling element and means to reciprocably introduce it into the said furnace chamber.

4. An apparatus for the rapid heating and/or annealing of material comprising a ferrous or non-ferrous metal as claimed in claim 1, said means to cool said chamber including a coolant line with conduits for the passage thereof.

5. An apparatus for the rapid heating and/or annealing of material comprising a ferrous or non-ferrous metal as claimed in claim 1, said means to subject said material to vapors including a metal bath and a means to heat said bath to a vapor, the condensation temperature of which is equal to the required heat treatment temperature of said material.

6. An apparatus for the rapid heating and/or annealing of material comprising a ferrous or non-ferrous metal as claimed in claim 5, said means to heat including means of doing so to a condensation temperature of said metal vapor equal to the required heat treatment temperature at a pressure of from 0.5 to 1 atmosphere.

7. An apparatus for the rapid heating and/or annealing of material comprising a ferrous or non-ferrous metal as claimed in claim 5, wherein the heat carrier is selected from the group consisting of sodium, potassium, lithium, and bismuth.

8. An apparatus for the rapid heating and/or annealing of material comprising a ferrous or non-ferrous metal as claimed in claim 5, comprising additional arrays of chambers in stages in the treatment of the said material, each of these stages including one said means to heat metal equipped with vacuum-tight chambers individually closable by valves said means to heat including means to do so at different temperatures in cycle times of less than 10 minutes and consequently to carry out said stages at different vapor pressures.

9. An apparatus for the rapid heating and/or annealing of material comprising a ferrous or non-ferrous metal as claimed in claim 8, wherein th cycle times are less than 3 minutes.

10. An apparatus for the rapid heating and/or annealing of material comprising a ferrous or non-ferrous metal as claimed in claim 8, further comprising: means to use the vapor of the boiling metal bath for heating and annealing in a multi-stage heat treatment array of chambers and means to use a metal bath of the same metal for cooling and quenching.

11. An apparatus for the rapid heating and/or annealing of material comprising a ferrous or non-ferrous metal as claimed in claim 10, wherein said means to heat include hardening and tempering means by way of martensite and an intermediate stage for the isothermal annealing of steel.

12. An apparatus for the rapid heating and/or annealing of material comprising a ferrous or non-ferrous metal as claimed in claim 10, wherein said means to heat include hardening and tempering means by way of martensite and the solution and aging annealing in case of a non-ferrous metal.

13. An apparatus for the rapid heating and/or annealing of material comprising a ferrous or non-ferrous metal as claimed in claim 1, comprising an additional plurality of vacuum-tight treatment chambers, arranged in succession, each chamber preceded and followed by locks.

14. An apparatus for the rapid heating and/or annealing of material comprising a ferrous or non-ferrous metal as claimed in claim 2, said first and said third chamber, located opposite form each other, in a set of outer chambers in a first linear alignment and at least one additional set of duplicate first and third chambers flanking said second chamber in a second alignment therewith.

15. An apparatus for the rapid heating and/or annealing of material comprising a ferrous or non-ferrous metal as claimed in claim 14, the outer chambers of the at least two sets being arranged in circumferential succession, equidistantly spaced from the said second chamber, each said outer chamber preceded and followed by locks.

16. An apparatus for the rapid heating and/or annealing of material comprising a ferrous or non-ferrous metal as claimed in claim 2, said second furnace chamber in which the material can be annealed, being located centrally in a cruciform arrangement of cooling and preheating baths connected to the periphery of the said second chamber.

17. An apparatus for the rapid heating and/or annealing of material comprising a ferrous or non-ferrous metal as claimed in claim 13, further comprising a plate; said metal bath fastened to the lower side of the said plate; means to drive the material to be annealed from one chamber to subsequent chambers and a hood covering the said chambers.

18. An apparatus for the rapid heating and/or annealing of material comprising a ferrous or non-ferrous metal as claimed in claim 13, said chambers separated from one another by two plates, an upper and a lower plate, the upper plate being rotatable in relation to the lower fixed plate and carrying hoods for receiving the material to be heated and transporting it from one treatment chamber to another, the individual treatment chambers being connected to the lower plate.

19. An apparatus for the rapid heating and/or annealing of material comprising a ferrous or non-ferrous metal as claimed in claim 18, further comprising a sealing means interposed between the upper and lower plates divided into two tubular elements and means to apply to their upper flange a selectable pressure against the movable upper plate.

20. A plant as claimed in claim 18, further comprising a pot for receiving the material to be heated in the first intermediate stage directly after charging, means to evacuate the chamber, and, in a second intermediate stage directly before discharging, a cooling trap to condense the residues of the metal vapor.

21. An apparatus for the rapid heating and/or annealing of material comprising a ferrous or non-ferrous metal as claimed in claim 18, further comprising means for evacuating the spaces between the plates, and, the hoods.

22. An apparatus for the rapid heating and/or annealing of material comprising a ferrous or non-ferrous metal as claimed in claim 14, further comprising an annular tunnel enclosing it.

23. A plant as claimed in claim 20, and means to operate under inert gas at a pressure lower than the atmospheric pressure.

24. An apparatus for the rapid heating and/or annealing of material comprising a ferrous or non-ferrous metal as claimed in claim 19, the lower plate carrying a lock valve under an opening for charging and discharging, and above the lock valve, the tubular element between the lower and upper plates a first tubular connection for evacuation and a second tubular connection to receive a cooling trap.

25. An apparatus for the rapid heating and/or annealing of material comprising a ferrous or non-ferrous metal as claimed in claim 13, the actual metal vapor bath being a double-shell furnace and means to provide controlled pressure inside the furnace.

26. An apparatus for the rapid heating and/or annealing of material comprising a ferrous or non-ferrous metal as claimed in claim 13, further comprising seals which lead to condensation and solidification of the metal vapor.

27. An apparatus for the rapid heating and/or annealing of material comprising a ferrous or non-ferrous metal as claimed in claim 13, and means for lowering the temperature of the boiling metal bath on every change of charge to such an extent that the vapor pressure is preferably lower than 10 mm Hg.

28. An apparatus for the rapid heating and/or annealing of material comprising a ferrous or non-ferrous metal as claimed in claim 18, further comprising tubular elements, which lie with their flanges at both ends against said upper and lower plates controllably pressed resiliently with their upper parts against the said upper plates.

29. An apparatus for the rapid heating and/or annealing of material comprising a ferrous or non-ferrous metal as claimed in claim 18, said treatment chambers functioning in succession as a charge and discharge stage;

an evacuation stage;
a preheating stage;
an austenization stage;
a hardening stage;
a tempering stage;
a cooling stage;
a condensing stage; and
a discharge stage.

* * * * *